US006421961B1

(12) United States Patent
Mallozzi

(10) Patent No.: US 6,421,961 B1
(45) Date of Patent: Jul. 23, 2002

(54) MODULAR ORGANIZER

(76) Inventor: Ernesto Mallozzi, 303 Mineola Road East, Mississauga, Ontario (CA), L5G 2G4

( * ) Notice: Subject to any disclaimer, the term of this patent is extended or adjusted under 35 U.S.C. 154(b) by 0 days.

(21) Appl. No.: 09/613,626

(22) Filed: Jul. 11, 2000

(51) Int. Cl.[7] ..... E04B 2/74
(52) U.S. Cl. ..... 52/36.5; 211/94.01
(58) Field of Search ..... 52/36.5, 36.4, 52/36.6; 211/94.01

(56) References Cited

U.S. PATENT DOCUMENTS 4,607,753 A * 8/1986 Radek
4,674,240 A 6/1987 Strausheim
4,805,783 A * 2/1989 Mayer
5,138,803 A 8/1992 Grossen
5,577,337 A * 11/1996 Lin
5,647,184 A * 7/1997 Davis
5,655,674 A 8/1997 Holztrager
5,819,490 A * 10/1998 Current

* cited by examiner

*Primary Examiner*—Blair M. Johnson
(74) *Attorney, Agent, or Firm*—Eugene J. A. Gierczak

(57) ABSTRACT

A panel, paneling system and method of installing the paneling system. The panel includes a tongue and groove for engaging adjacent panels, a profile having cross members for reinforcement and the ability to attach the panel or paneling system to a wall.

6 Claims, 1 Drawing Sheet

MODULAR ORGANIZER

FIELD OF THE INVENTION

This invention relates in general to a modular organizer and more particularly to panels having a means for engaging adjacent panels, wherein the panels are adapted for attachment to a wall and has a reinforcement means for improved strength.

BACKGROUND OF THE INVENTION

There are a variety of display systems for organizing a host of articles, which are well known in the art. Traditionally, display systems have included display units or paneling that are mounted on the wall. These systems typically included panels or boards having parallel slots or channels into which hardware or attachment mechanisms can be inserted and secured. The focus of these systems has been to provide the user a means for displaying articles, which comprise of slots and panels that are easy to install and are durable.

Prior art display paneling systems have been devised to address the issues surrounding installation. For example, U.S. Pat. No. 4,674,240 issued on Jun. 23, 1987 to Straushеim relates to a wall panel system comprising of units of extruded plastic strips having vertically-spaced, horizontally-extending C-shape channels for receiving prongs or clips of various types of hangers.

U.S. Pat. No. 5,138,803 issued to Grossen on Aug. 18, 1992 relates to a display panel assembly having a regular series of undercut slots lined with identical channel inserts that improve the appearance and strength of the panel in the slot areas. The channel insert is capable of being installed in a slot from the face of the panel with a resilient snap fit.

U.S. Pat. No. 5.655,674 issued on Aug. 12, 1997 to Holztrager relates to an exhibit panel comprising a backboard made of plastic material having a pair of spaced apart walls secured by a plurality of spaced apart longitudinal ribs disposed between the walls, and a plurality of parallel spaced apart longitudinal profiles glued to the blackboard.

Prior art inventions however are still cumbersome to install because of the weight of the paneling, are costly to produce and are often are not strong enough to support a variety of articles. Thus a modular organizer that is cost effective to produce, lightweight yet able to support heavy articles, and is easy to install with minimum effort is desirable.

SUMMARY OF THE INVENTION

An object of one aspect of the present invention is to provide an improved modular organizer and a method for installing it.

In accordance with one aspect of the present invention there is provided a panel comprising of a means for engaging adjacent panels. The panel is adapted for attachment to a wall and has a reinforcement means within the panel for improved strength.

Conveniently, the means for engaging adjacent panels may further comprise of a tongue and groove on each panel for engagement with adjacent panels. Preferably, the panel may be adapted for attachment to a wall by a fastening means.

In accordance with another aspect of the present invention there is provided a paneling system comprising of a series of panels adapted for attachment to a wall. The series of panels have a means for engaging one another and a reinforcement means.

In accordance with another aspect of the present invention there is provided a method for installing a paneling system comprising of mounting a series of panels to a wall. The series of panels may have a reinforcement means within the panels and a means for engaging adjacent panels. The series of panels may be secured to the wall by engaging the means for engaging adjacent panels of at least two panels to one another.

In accordance with a final aspect of the present invention there is provided a kit for a modular organizer comprising of a series of panels having a reinforcement means within each of the panels. The kit may further include a tongue and a groove associated with each of the panels for engagement of adjacent panels and a fastening means for securement of the series of panels to a wall.

Advantages of the present invention are: easy installation of the panel, the paneling system and the method of installation as the panels are lightweight; quick installation as the panels are not cumbersome and connect to adjacent panels quickly and easily; simple securing of the panels to one another and to the wall; improved strength of the panels and paneling system as the panels contain reinforced cross-members within the panels, therefore overcoming compressive and tensile forces; panels are made from durable material, such as polymer resin that improves the longevity of the panel and paneling system and allows the installer to easy handle and cut the panels to the desired length.

BRIEF DESCRIPTION OF THE DRAWINGS

A detailed description of the preferred embodiments are provided herein below by way of example only and with reference to the following drawings, in which.

Figure 3:
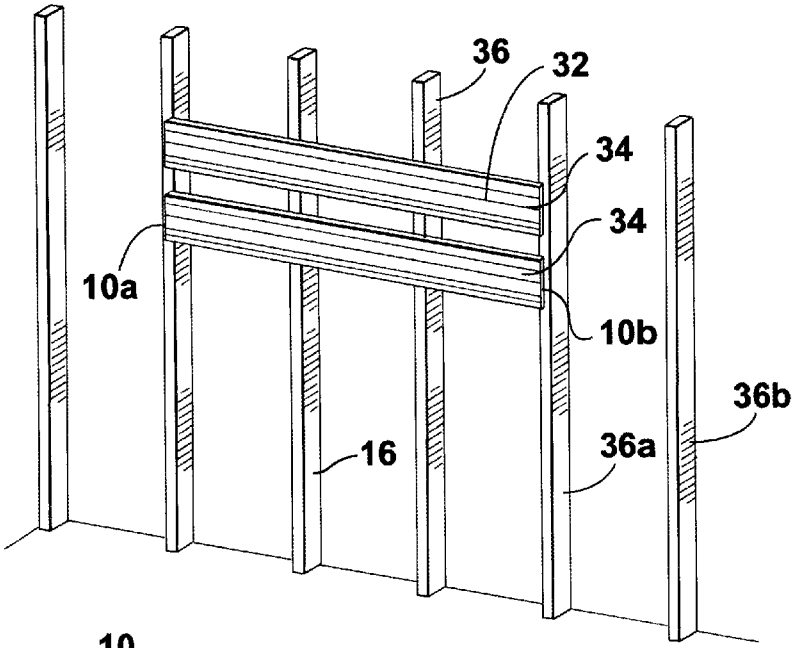
FIG. 3 in a perspective view, illustrates the paneling system of FIG. 1 during installation.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Figure 1:
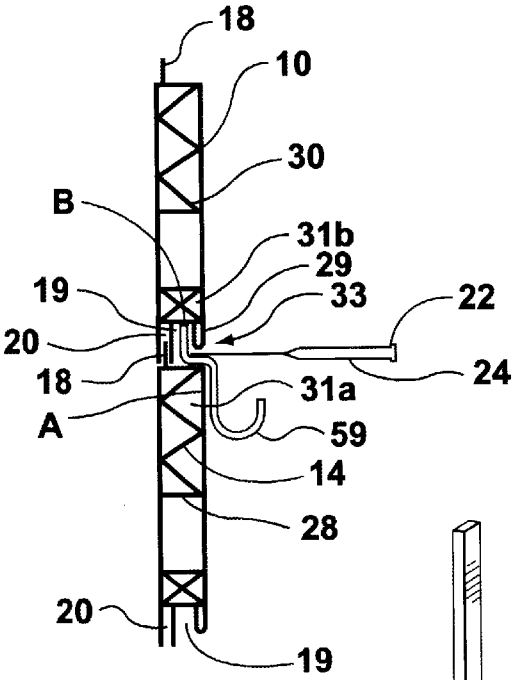
FIG. 1 in a cross-sectional view, illustrates a panel in accordance with a preferred embodiment of the present invention.

Referring to FIG. 1 there is illustrated in a cross-sectional view, a panel 10 in accordance with a preferred embodiment of the present invention. The panel 10 includes a means for engaging adjacent panels 12 and a reinforcement means 14 within the panel 10. The panel 10 may be adapted for attachment to wall 16.

The means for engaging adjacent panels 12 may further comprise of a tongue 18 and a groove 20 for each panel 10. The tongue 18 of one panel 10 may engage the groove 20 of an adjacent panel 10, and the groove 20 may engage the tongue 18 of another adjacent panel 10. The panel 10 may further comprise of a channel 19 or recess that may be accessed from the front of the panel 10 to allow the installer to secure attachment means 29 or hooks from which articles may be attached for display on the panel 10.

The panel 10 may be adapted for attachment to a wall 16 by a fastening means 22. The fastening means 22 may be further defined as a screw 24 or other means of attachment.

The fastening means 22 may attach the panel 10 to the wall 16 at a point 26 where the groove 20 of one panel 10 and the tongue 18 of another panel 10 engage. The installer may use a minimum of two fastening means 22 to secure the panel 10 to the wall 16. The fastening means 22 may be inserted into a stud 36 on a 2×4 or 2×6 piece of lumber in the wall 16 or into the wall 16 directly.

The reinforcement means 14 within the panel 10 may further comprise of a profile 28 of cross members 30. More specifically, the arrangement of the cross members 30 allows for the force (ie. compressive and tensile forces) exerted against the panel 10 from the articles displayed on the panel 10, to be born against the cross members 30 at specific points 31a and 31b. The profile 28 does not require cross members 30 where little compressive force is exerted on the panel 10.

In particular where a hook 29 is inserted into the recess 19, the lower portion of the hook 29 will bear against the surface adjacent the cross member 30 at point 31 and will resist compression forces A. The upper portion of hook 29 will tend to pull or bear against lip 33 and accordingly the cross members 30 at point 31 will resist the tensile forces B. Cross members 30 may be absent in the region between points 31*a* and 31*b*, particularly if the region does not experience appreciable compressive or tensile forces.

The cross members 30 within the panel 10 may be arranged in a number of different profiles 28 to provide additional strength to the panel 10. The different profiles 28 may be determined during the extrusion of the panel 10. The panel 10 may be extruded in a variety of materials, polymer resin being the preferred material as it provides additional strength, yet is lightweight, easy to keep clean, may come in a variety of colours and is easy to handle by the installer.

Referring to FIG. 3, another embodiment of the present invention includes a paneling system 32 comprising of a series of panels 34 adapted for attachment to a wall 16. The series of panels 34 have a means for engaging one another 12 and a reinforcement means 14. The paneling system 32 may be further defined with the same elements as described above for the panel 10 embodiment. The paneling system 32 allows for the interlocking of the series of panels 34 and the securement of these panels 34 to the wall 16 to form a modular organizer from which a variety of articles may be attached to.

Figure 2:
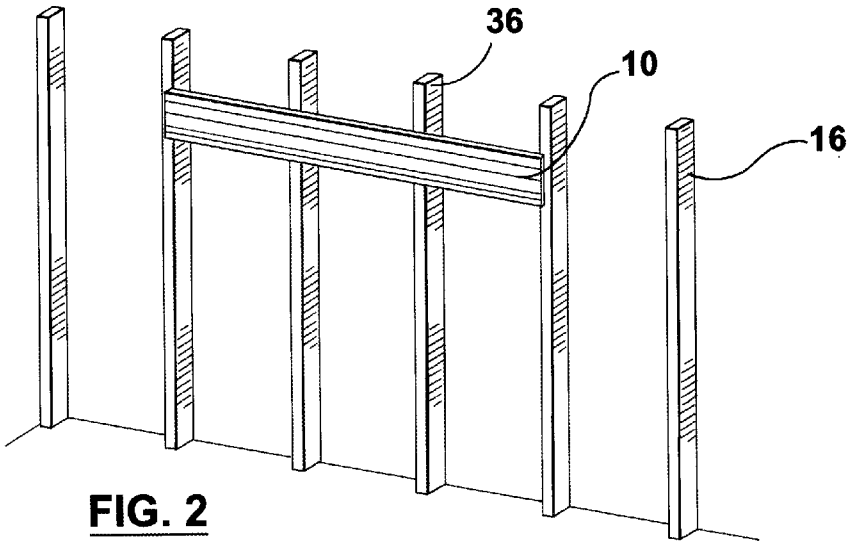
FIG. 2 in a perspective view, illustrates the panel of FIG. 1 during installation.

In FIGS. 2 and 3 there is illustrated in perspective views the method of installation of the panel 10 and paneling system 32 in operation. In operation, a panel 10 is leveled on the wall 16 at the appropriate or desired point for attachment to the wall 16. The panel 10 comprising of a tongue 18 and a groove 20 as described above, is secured to the wall 16 using a fastening means 22 such as a screw 24 at a point on the groove 20. For easy installment of the paneling system, it is preferred that the first panel 10 is installed at the bottom of the wall 16 so that the paneling system 32 is built from the bottom up. When installed in this fashion, it is easier for the installer to add additional panels 10 and ensure a tight joint or fit between adjacent panels 10.

A second panel 10 having a tongue 18 and groove 20 is placed adjacent to the first panel 10 so that the tongue 18 of the first panel 10 engages the groove 20 of the second panel 10 and the panels 10 or series of panels 34 are joined or interlocked together tightly. The fastening means 22 such as a screw 24 may be screwed into the panels 34 at a point 26 where the tongue 18 and the groove 20 interlock or engage and then into the wall 16 or the joist 36. The remaining series of panels 34 or the desired number of panels 10 may be attached to the wall 16 directly or to the joist 36 depending on the surface that the paneling system 32 is being installed onto.

Additional fastening means 22 may be installed into the wall 16 or stud 36 for additional stability. End caps may be placed onto the edges of the finished paneling system 32 to provide a more finished or professional look to the paneling system 32.

As can be seen from FIG. 2 and 3, an entire wall 16 may be constructed with a plurality of panels 10 abutting vertically one another as described, as well as horizontally abutting side edges 10*a* and 10*b* of each other. In other words, by looking at FIG. 3 one may abut side 10*a* of one panel 10 with side 10*b* of another panel 10, and secure the other panel 10 to studs 36*a* and 36*b*.

The series of panels 34 may form part of a kit for a modular organizer that comprises of the series of panels 34 having a reinforcement means 24 within each of the panels 34. The kit may further include a tongue 18 and a groove 20 associated with each of the panels 34 for engagement of adjacent panels 34 and a fastening means 22 for securement of the series of panels 34 to a wall 16. The kit may be adapted for displaying specific articles associated with specific uses such as gardening or tools or the like. The kit will also include hooks 29 or the like which can be manually displaced along the recess 19 at the desired location.

Other variations and modifications of the invention are possible. All such modifications or variations are believed to be within the sphere and scope of the invention as defined by the claims appended hereto.

I claim:

1. A paneling system comprising a plurality of panels adapted for engagement with adjacent panels and for attachment to a wall, each said plurality of panels having a means for engaging one another, a hollow interior and a plurality of angled reinforcement members in the vicinity of said engaging means, a plurality of panels adapted for engagement with adjacent panels and for attachment to a wall, each said, said engaging means comprising a tongue on one side of said panel and a leg and groove on an opposite side of said panel, said leg spaced from said groove, said groove extending outwardly from said opposite side beyond said leg so as to define a channel between said leg and said groove wherein said tongue of one panel intersects with the groove of the adjacent panels.

2. A paneling system as claimed in claim 1 wherein said plurality of panels are adapted for attachment to a wall by a fastening means.

3. A paneling system as claimed in claim 2 wherein said fastening means are screws for fastening said plurality of panels to said wall.

4. A paneling system as claimed in claim 3 wherein said reinforcement members in the vicinity of said groove present an X-shaped cross-section and said reinforcement members in the vicinity of said tongue present a W-shaped cross-section.

5. A panel system comprising;

a plurality of panels each adapted for engagement with adjacent panels and attachment to a wall by screws;

each said plurality of panels having an hollow interior, a tongue on one side and a groove on an opposite side of said panel, said tongue of one panel adapted to engage said groove of said adjacent panel, and said groove of one panel adapted to engage said tongue of said adjacent panel, so as to form a paneling system, each said panel having angled reinforcement members in the vicinity of said tongue and groove;

said opposite side of each said panel presents a leg extending outwardly from said opposite side and spaced from said groove, said groove extending outwardly from said opposite side beyond said leg so as to define a channel between groove and leg.

6. A kit for a modular organizer comprising:

(a) a plurality of panels having a tongue extending from one side of said panel and a spaced leg and groove extending outwardly from an opposite side of said panel, said groove extending beyond said leg, said tongue adapted for insertion into said groove so as to define a channel between adjacent panels;

(b) a fastening means for securement of said series of panels to a wall;

(c) a hook adapted for insertion into said channel.

* * * * *